US008312797B2

(12) United States Patent
Hsu

(10) Patent No.: US 8,312,797 B2
(45) Date of Patent: Nov. 20, 2012

(54) OPENING CUTTER ASSEMBLY FOR HAVING OPENING PERFORATION LINE ON PLASTIC PACKAGING FILM

(75) Inventor: Wei-Hsin Hsu, Taipei (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 340 days.

(21) Appl. No.: 12/585,020

(22) Filed: Sep. 1, 2009

(65) Prior Publication Data

US 2010/0242698 A1 Sep. 30, 2010

(30) Foreign Application Priority Data

Mar. 31, 2009 (TW) ..... 98110581 A

(51) Int. Cl.
*B26D 1/40* (2006.01)
*B26D 3/08* (2006.01)

(52) U.S. Cl. ..... 83/332; 83/348

(58) Field of Classification Search ..... 83/331, 83/332, 348, 55, 345, 496, 501
See application file for complete search history.

(56) References Cited

U.S. PATENT DOCUMENTS 2,387,767 A * 10/1945 Nordquist ..... 83/343
2,682,306 A * 6/1954 Schriber ..... 83/346
3,283,635 A * 11/1966 Johnson ..... 83/345
3,823,633 A * 7/1974 Ross ..... 83/346
4,412,467 A * 11/1983 DeSanto ..... 83/346
4,826,090 A * 5/1989 Orphall ..... 241/191
5,452,634 A * 9/1995 Wilson ..... 83/99
5,826,475 A * 10/1998 Mysliwiec ..... 83/116
5,935,367 A * 8/1999 Hollenbeck ..... 156/252

* cited by examiner

*Primary Examiner* — Ghassem Alie
(74) *Attorney, Agent, or Firm* — Rosenberg, Klein & Lee

(57) ABSTRACT

An opening cutter assembly for forming an opening perforation line in a plastic packaging film by rolling the plastic packaging film between the opening cutter assembly and an anvil roll of a rolling mechanism when the plastic packaging film is fed through the rolling mechanism. The opening cutter assembly includes an opening cutter shaft, at least one opening cutter seat, and at least one opening cutter blade. The opening cutter shaft has at least one containing compartment. The opening cutter seat is installed in and engaged to the containing compartment by a cutter seat mounting mechanism. The opening cutter blade is mounted to each opening cutter seat. When the opening cutter blade gets worn out due to long term operation and must be replaced, simply dismounting the cutter seat mounting mechanism allows the opening cutter seat and the opening cutter blade to be removed from the containing compartment.

10 Claims, 11 Drawing Sheets

OPENING CUTTER ASSEMBLY FOR HAVING OPENING PERFORATION LINE ON PLASTIC PACKAGING FILM

FIELD OF THE INVENTION

The present invention relates to an opening cutter assembly, and in particular to an opening cutter assembly for having an opening perforation line on a plastic packaging film.

BACKGROUND OF THE INVENTION

A packaged tissue paper pack available in the market requires a user to pull up a self-sticking label in order to tear an opening perforation line formed in a plastic packaging film, whereby an opening is formed to allow tissue paper sheets to be withdrawn from the tissue paper pack. The self-sticking label can be re-attached to close the opening. In the next time of use, the self-sticking label is peeled off again to allow withdrawal of the tissue paper sheets. This may be repeated several times until the tissue paper sheets are used up.

SUMMARY OF THE INVENTION

For the opening perforation line formed in the above described known plastic packaging film, in the first time of use, the perforation line must be torn apart by a user. The perforation line is formed by rolling with a perforation line rolling cutter that is susceptible to wearing and must be replaced frequently. For the state-of-the-art techniques, the rolling cutter is formed by welding one or plural cutters to a rotary shaft. Such a construction makes it necessary to replace the whole set of rolling cutter once one of the cutters wears out so that the costs and time consumed in replacement of parts are increased and the manufacturing costs are thus raised. Further, for the state-of-the-art techniques, the height of the cutters projecting above the rotary shaft is fixed and the whole machine must be moved in order to realize adjustment of height. The operability is apparently poor and does not suit the need of the industry.

Thus, an objective of the present invention is to provide an opening cutter assembly for having opening perforation line on plastic package film, which facilitates efficient replacement when the rolling cutter wears out.

Another objective of the present invention is to provide an opening cutter assembly for having opening perforation line on plastic package film, which facilitates efficient adjustment of operation height of the rolling cutter.

The solution adopted in the present invention to overcome the problems of the conventional techniques comprises an opening cutter assembly for having opening perforation line on plastic package film, which comprises an opening cutter shaft, at least one opening cutter seat, and at least one opening cutter blade. The opening cutter shaft has at least one containing compartment. The opening cutter seat is installed in and engaged to the containing compartment of the opening cutter shaft by a cutter seat mounting mechanism. The opening cutter blade is mounted to each opening cutter seat. The cutter seat mounting mechanism comprises at least one cutter bolt, at least one threaded cutter hole and at least one post hole. The cutter hole is defined in a bottom of the containing compartment of the opening cutter shaft. The post hole is defined in the opening cutter seat and corresponds to the cutter hole of the opening cutter shaft. The post hole and the cutter hole are fastened by the cutter bolts to have the opening cutter seat engaging with the opening cutter shaft. When the opening cutter blade gets worn out due to long term operation and must be replaced, simply releasing the cutter bolt of the cutter seat mounting mechanism allows the opening cutter seat and the opening cutter blade to be removed out of the containing compartment of the opening cutter shaft.

The opening cutter seat has an end surface and the opening cutter shaft has a cylindrical circumferential surface. In case it is found that the end surface of the opening cutter seat and the cylindrical surface of the opening cutter shaft do not match with each other along the outer cylindrical contour, or the anvil roll and the opening cutter blade cannot carry out rolling operation properly, the cutter bolt is first released and an adjustment bolt engaging an adjustment hole is adjusted in such a way that when the adjustment bolt gets into contact with the bottom of the containing compartment of the opening cutter shaft, further rotating the adjustment bolt in either clockwise direction or counterclockwise direction may adjust the assembled height of the opening cutter seat and when a desired height is reached, the cutter bolt is firmly secured. This operation can be carried out repeatedly until the anvil roll and the opening cutter blade can properly carry out rolling operation to have a uniform opening perforation line at a predetermined location in the plastic packaging film.

The technical solution provided by the present invention significantly reduces the time spent in replacing worn parts because the opening cutter blade is coupled to the opening cutter shaft through the opening cutter seat and the opening cutter seat is mounted to the opening cutter shaft by the cutter seat mounting mechanism, so that efficient replacement can be realized without changing the whole cutter assembly when the opening cutter blade gets worn out, and thus reduces the manufacturing costs. Further, since the operation height of the opening cutter seat can be minutely adjusted through the adjustment bolt, efficient adjustment of the opening cutter blade to mate the operation height of the anvil roll can be done without adjusting the overall height of the whole machine. Thus, labor and time saving can be realized and the operability of the device is enhanced to suit the need of the industry.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
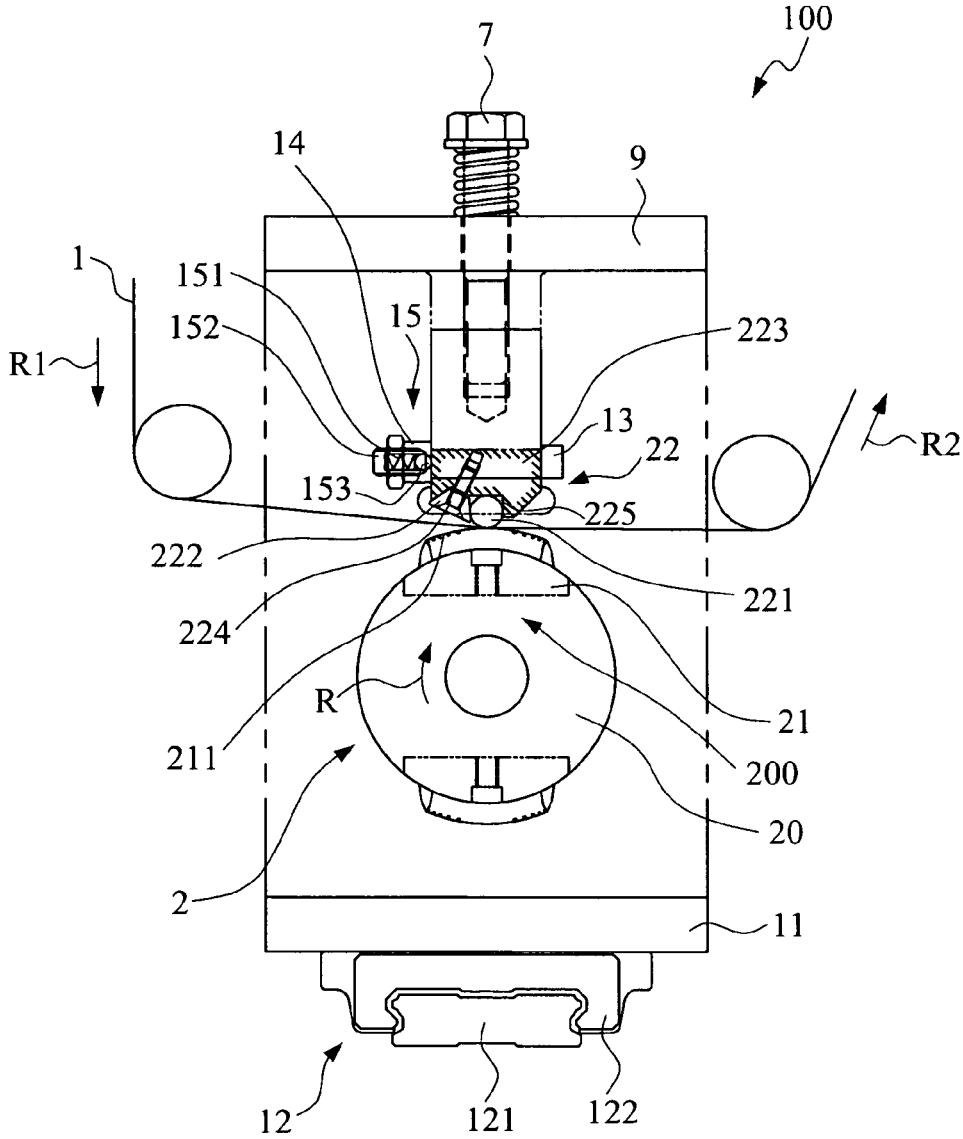
FIG. 1 is a schematic side elevational view of a rolling mechanism for having an opening perforation line on a plastic packaging film.
Figure 2:
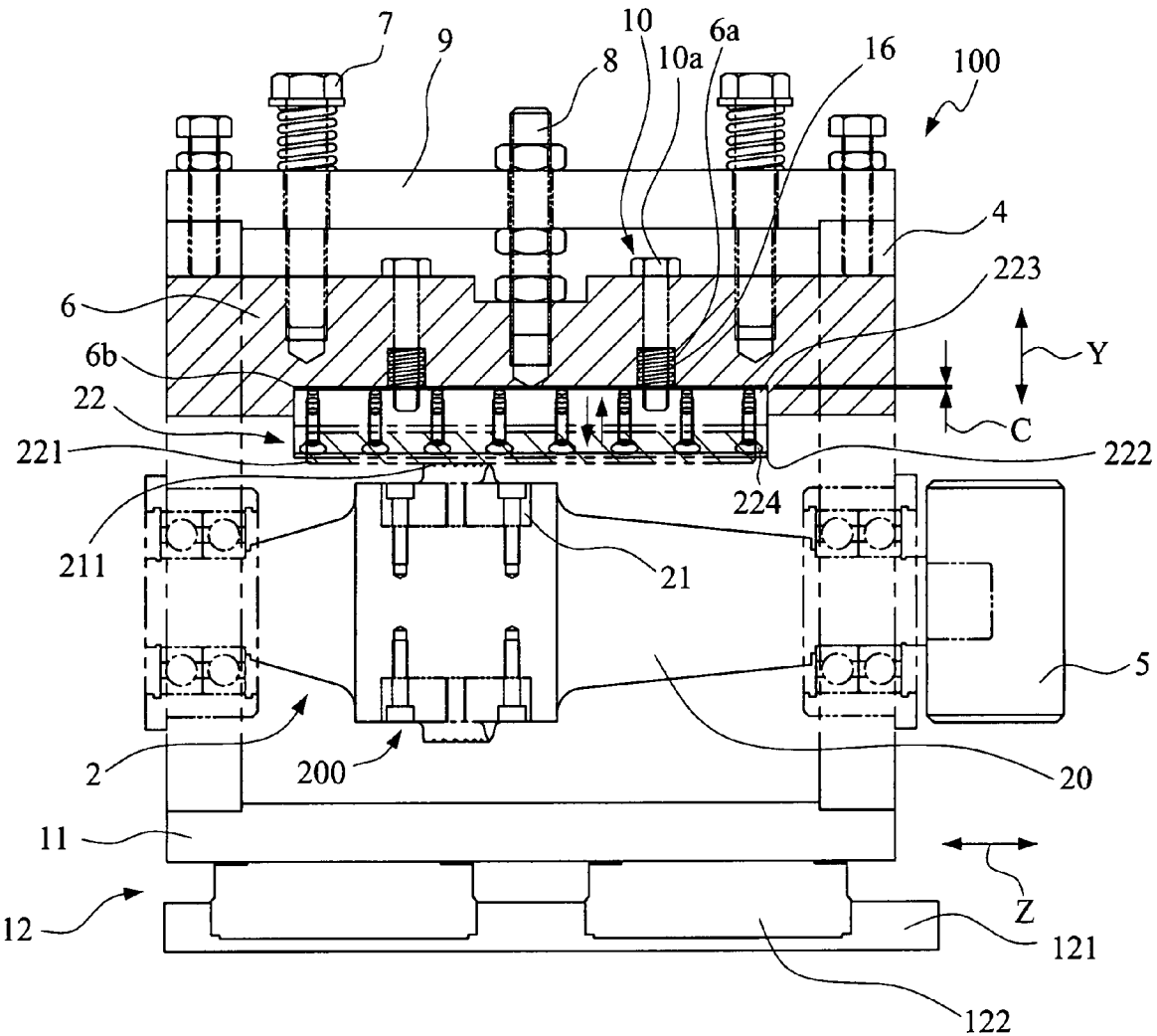
FIG. 2 is a schematic front view of the rolling mechanism for having an opening perforation line on a plastic packaging film.

With reference to the drawings and in particular to FIGS. 1 and 2, which show a schematic side elevational view and a schematic front view of a rolling mechanism for having an opening perforation line on a plastic packaging film respectively, the rolling mechanism for having an opening perforation line on a plastic packaging film, generally designated at 100, comprises a base frame 4, a carriage frame 6, at least one fastening bolt 7, a top board 9, a pressure bearing unit 22, an impact cushioning mechanism 10, and an opening cutter assembly 2. The top board 9 is mounted to the base frame 4 and the fastening bolt 7 extends through the top board 9 and engages the carriage frame 6.

The pressure bearing unit 22 comprises a pressure bearing seat 223, an anvil roll 221, and a retention plate 222. The pressure bearing seat 223 has a receptacle channel 225. The retention plate 222 is engaged with the pressure bearing seat 223 and is located at one side of the receptacle channel 225 in order to position the anvil roll 221 in the receptacle channel 225. The impact cushioning mechanism 10 is coupled between the carriage frame 6 and the pressure bearing seat 223 of the pressure bearing unit 22. In the instant embodiment, the pressure bearing unit 22 is made of a high hardness material, such as tungsten carbide. The anvil roll 221 possesses the capability of absorbing impact and vibration. Use of high hardness abrasion resistant material is helpful in increasing lifespan of the anvil roll 221.

The impact cushioning mechanism 10 comprises at least one bolt 10*a* and at least one pressure bearing spring 16. The bolt 10*a* extends through the carriage frame 6 and engages the pressure bearing seat 223 of the pressure bearing unit 22. The pressure bearing spring 16 is set in a respective cavity 6*a* formed within the carriage frame 6 and is sleeved around of the bolt 10*a*. Opposite ends of the pressure bearing spring 16 are respectively supported by the cavity 6*a* and the pressure bearing seat 223 for adjusting a penetration depth with respect to the bolt 10*a* fastening. The pressure bearing spring 16 provides resiliency that maintains a Y-axis buffering gap C (approximately 2-0.4 mm) between the carriage frame 6 and the pressure bearing seat 223 of the pressure bearing unit 22.

A regulating bolt 8 extends through the top board 9 and engages the carriage frame 6. The regulating bolt 8 is used for adjusting a distance between the carriage frame 6 and the top board 9 to result that a distance between the pressure bearing unit 22 and an opening cutter shaft 20 is adjusted correspondingly to ensure effective rolling and smooth operation between the anvil roll 221 and an opening cutter blade 211.

The opening cutter assembly 2 is arranged adjacent to the anvil roll 221 of the pressure bearing unit 22 and comprises the opening cutter shaft 20, at least one opening cutter seat 21, and at least one opening cutter blade 211. The opening cutter seat 21 is coupled to the opening cutter shaft 20 through a cutter seat mounting mechanism 200, and the opening cutter blade 211 is mounted to the opening cutter seat 21. The opening cutter shaft 20 is coupled to the base frame 4 and is indirectly driven by a motor (not shown) via a pulley 5 to rotate in a rotation direction R.

A plastic packaging film 1 is fed along a feeding path R1 into the rolling mechanism for having an opening perforation line on a plastic packaging film 100 and is rolled between the opening cutter blade 211 of the opening cutter assembly 2 and the anvil roll 221 of the pressure bearing unit 22 whereby an opening perforation line 3 (also see FIG. 8) is formed at a predetermined location in the plastic packaging film 1, and the plastic packaging film 1 is then discharged along a discharge path R2. The plastic packaging film 1 is a pliable thin film material.

The rolling mechanism for having an opening perforation line on a plastic packaging film 100 further comprises a bottom board 11 and a rail assembly 12. The rail assembly 12 comprises a rail 121 and at least one slide block 122. The bottom board 11 is coupled to an underside of the base frame 4 and the slide block 122 of the rail assembly 12 is coupled to the bottom board 11. The rail 121 is coupled to a base of other assemblies/units (not shown in the drawings). The rolling mechanism 100 for having an opening perforation line on a plastic packaging film is controlled by a screw control unit (not shown) to have the slide block 122 sliding on the rail 121 along Z axis for setting the anvil roll 221 and the opening cutter blade 211 to roll and form the opening perforation line 3 at a desired and correct location on the plastic packaging film 1.

Figure 3:
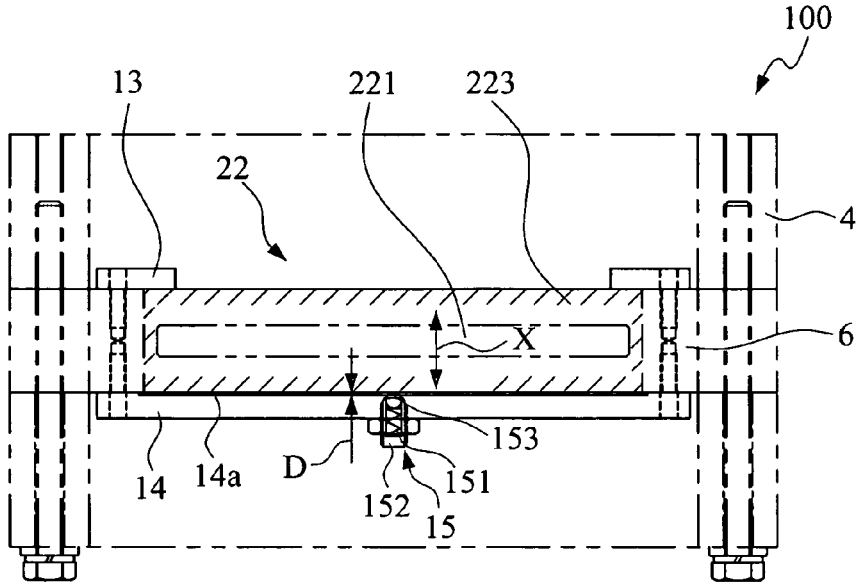
FIG. 3 is a schematic top plan view of the rolling mechanism for having an opening perforation line on a plastic packaging film.

Referring to FIG. 3, which shows a schematic top plan view of the rolling mechanism for having an opening perforation line on a plastic packaging film, a plurality of short retention blocks 13 is fixed to the carriage frame 6 to secure the pressure bearing seat 223 of the pressure bearing unit 22 and a long retention bar 14 is engaged to an opposite side of the carriage frame 6. The long retention bar 14 has a groove 14*a* forming a surface that defines an X-axis buffering gap D (approximately 2-0.4 mm) between the long retention bar 14 and the pressure bearing seat 223.

The long retention bar 14 is provided, at a substantially central portion, with a resilient cushioning mechanism 15, which can be for example composed of a resiliently biased positioning bead that is readily available from the market. In the embodiment illustrated, the resilient cushioning mechanism 15 generally comprises a regulation spring 151, a resilient bolt 152, and a pressure bearing end 153. The resilient bolt 152 has an end extending into the groove 14*a* of the long retention bar 14 to have the pressure bearing end 153 against the pressure bearing seat 223 of the pressure bearing unit 22. The regulation spring 151, or an equivalent resilient element, constituting the resilient cushioning mechanism 15, provides the function of cushioning to absorb the power of impact and vibration. When the anvil roll 221 or the pressure bearing unit 22 is subjected to an external force, the presence of the resilient cushioning mechanism 15 provides the anvil roll 221 or the pressure bearing unit 22 with the capability of absorbing impacts and vibrations along the X axis.

Figure 4:
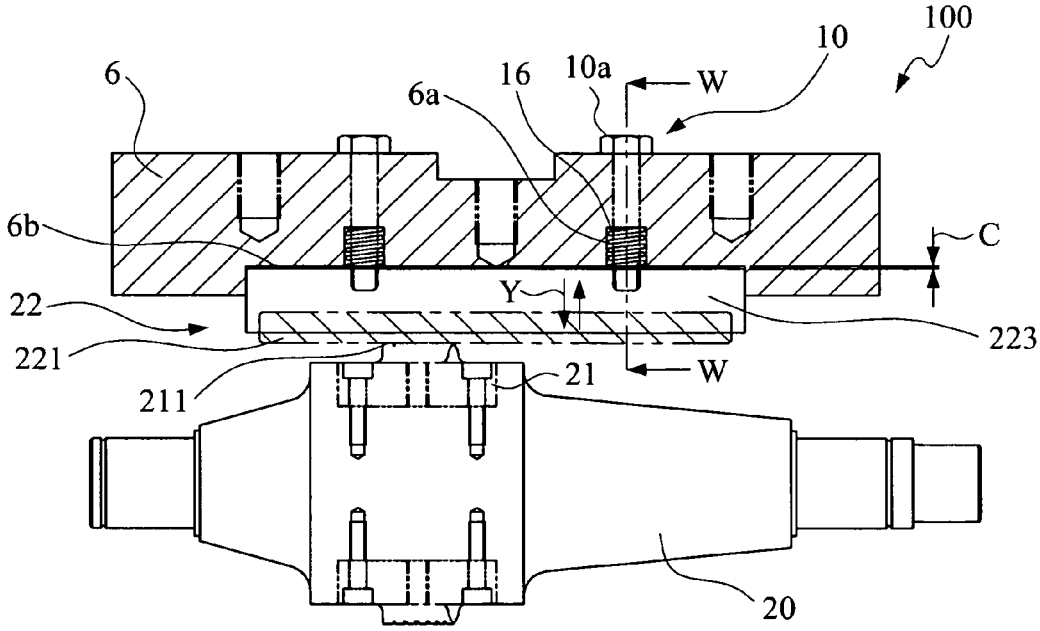
FIG. 4 is a schematic front view of the rolling mechanism for having an opening perforation line on a plastic packaging film, showing a pressure bearing unit coupled to a carriage frame.

Referring to FIG. 4, which is a schematic front view of the rolling mechanism for having an opening perforation line on a plastic packaging film, showing the pressure bearing unit coupled to the carriage frame, the pressure bearing spring 16 of the impact cushioning mechanism 10 is set in the cavity 6*a* of the carriage frame 6 and sleeves around the outer circumference of the bolt 10*a*. The bolt 10*a* is screwed into the pressure bearing seat 223 of the pressure bearing unit 22 and properly adjusted to have a surface of the grooved channel 6*b* that is formed in a central portion of the carriage frame 6 defining the Y-axis buffering gap C with respect to the pressure bearing seat 223 of the pressure bearing unit 22. Thus, when the anvil roll 221 or the pressure bearing unit 22 is subjected to an external force, the presence of the pressure bearing spring 16 of the impact cushioning mechanism 10 provides the pressure bearing unit 22 with the capability of absorbing impacts and vibrations along the Y axis. In other words, the anvil roll 221 is capable to bear impacts and vibrations along the Y axis.

Figure 5:
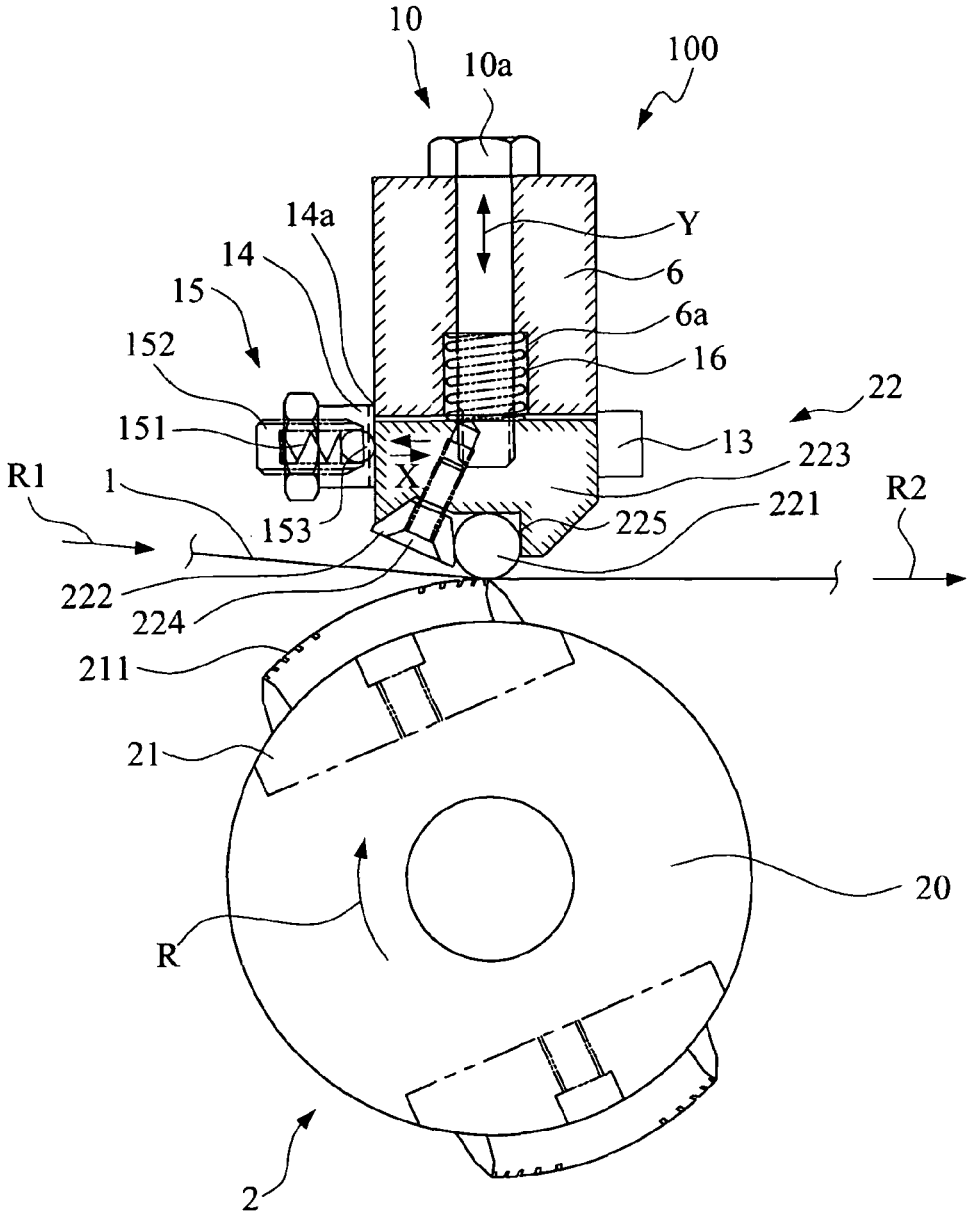
FIG. 5 shows an initial phase when an opening cutter shaft of the present invention is rotated to have an opening cutter blade thereof making an initial rolling engagement with an anvil roll, wherein an impact cushioning mechanism, the carriage frame, and the pressure bearing unit are shown in cross-sectional form taken along line W-W of FIG. 4.
Figure 6:
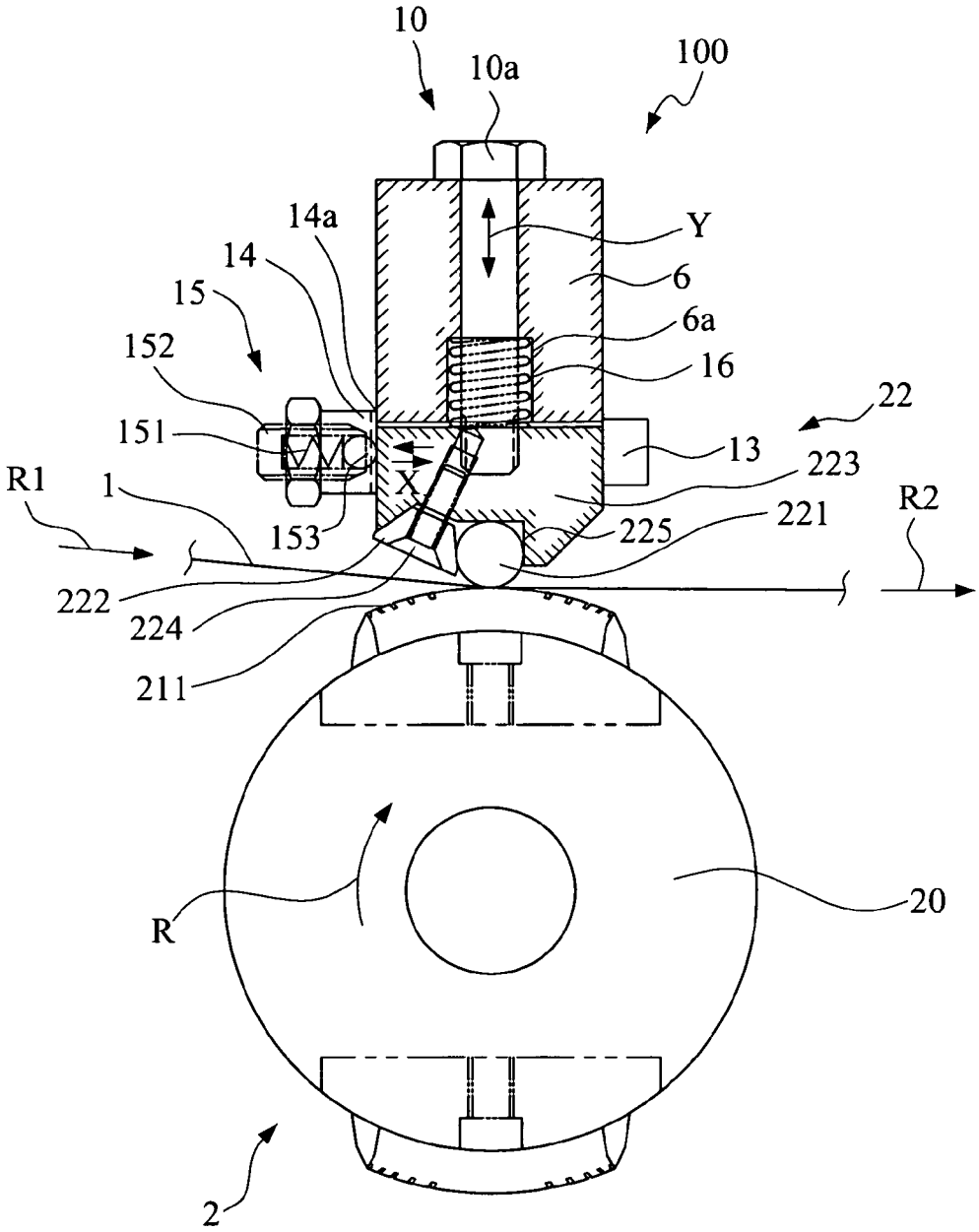
FIG. 6 shows an intermediate phase when the opening cutter shaft of the present invention is rotated to have the opening cutter blade thereof making rolling engagement with the anvil roll with an intermediate portion thereof, wherein the impact cushioning mechanism, the carriage frame, and the pressure bearing unit are shown in cross-sectional form taken along line W-W of FIG. 4.
Figure 7:
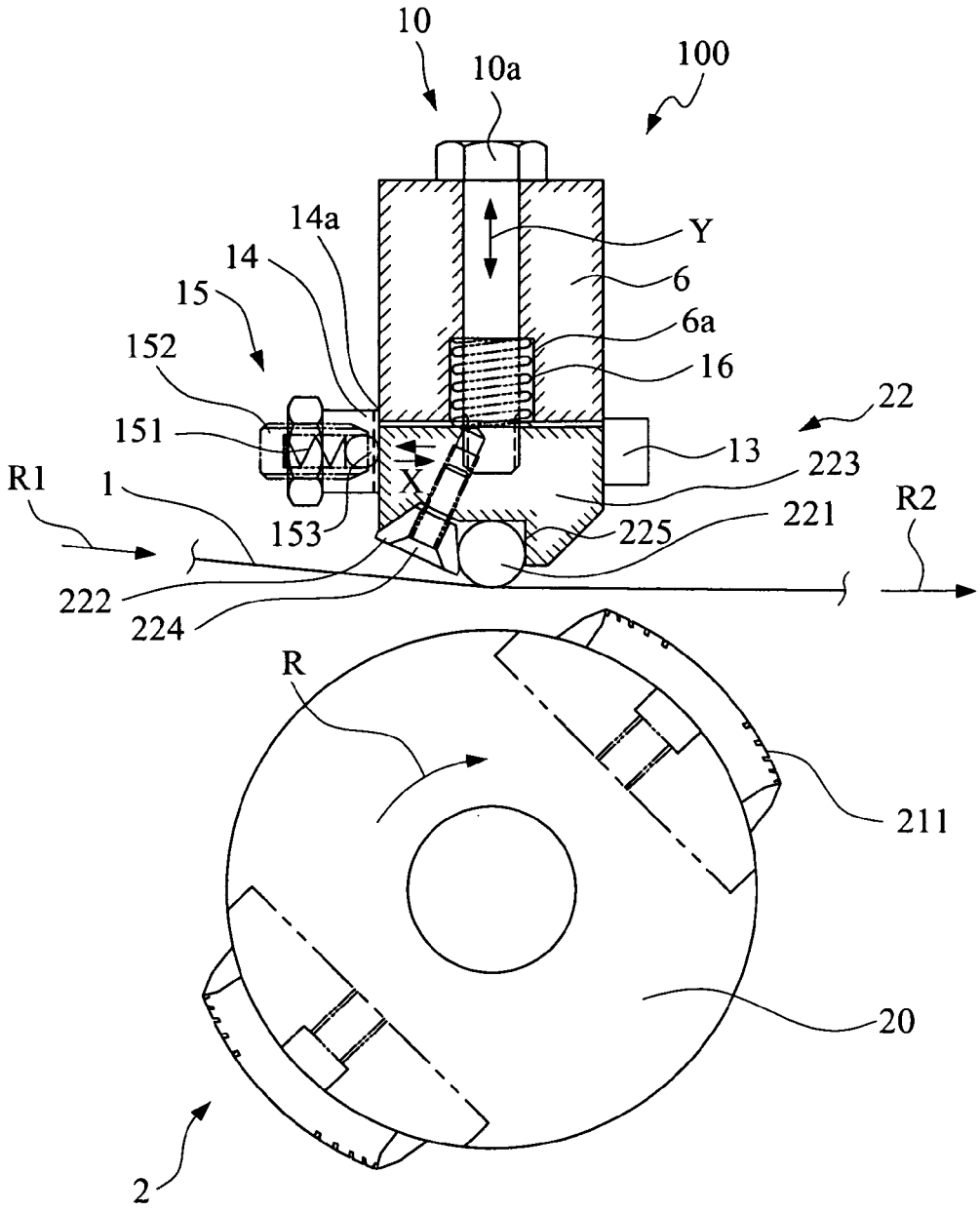
FIG. 7 shows a final phase when the opening cutter shaft of the present invention is rotated to have the opening cutter blade thereof disengaged from the anvil roll, wherein the impact cushioning mechanism, the carriage frame, and the pressure bearing unit are shown in cross-sectional form taken along line W-W of FIG. 4, wherein the impact cushioning mechanism, the carriage frame, and the pressure bearing unit are shown in cross-sectional form taken along line W-W of FIG. 4.

Reference is simultaneously made to FIGS. 5-7, in which the impact cushioning mechanism, the carriage frame, and the pressure bearing unit are shown in cross-sectional form taken along line W-W of FIG. 4. FIG. 5 shows an initial phase when the opening cutter shaft in accordance with the present invention is rotated to have the opening cutter blade thereof making an initial rolling engagement with the anvil roll. FIG. 6 shows an intermediate phase when the opening cutter shaft in accordance with the present invention is rotated to have the opening cutter blade thereof making rolling engagement with the anvil roll with an intermediate portion thereof. FIG. 7 shows a final phase when the opening cutter shaft in accordance with the present invention is rotated to have the opening cutter blade thereof disengaged from the anvil roll. As shown, when the plastic packaging film 1 is fed into the rolling mechanism for having an opening perforation line on a plastic packaging film 100, the plastic packaging film 1 is subjected to rolling between the anvil roll 221 and the opening cutter blade 211 to form the opening perforation line 3. The impact force that the opening cutter blade 211 applies to the anvil roll 221 is buffered by the resilient cushioning mechanism 15 so that the impact and vibration along the X axis are effectively absorbed. Further, the pressure bearing spring 16 of the impact cushioning mechanism 10 absorbs the impact and vibration that the opening cutter blade 211 induces on the anvil roll 221 along the Y axis.

The pressure bearing unit 22 comprises at least one bolt 224. When the bolt 224 is in a tightened condition (see FIG. 7), the retention plate 222 is engaged with the pressure bearing seat 223 and located at one side of the receptacle channel 225, whereby the anvil roll 221 is set to have an initial contact edge facing the opening cutter assembly 2 in a given direction and when the opening cutter shaft 20 of the opening cutter assembly 2 is driven to rotate, the initial contact edge of the anvil roll 221 engages and receives the rolling operation applied by the opening cutter blade 211. When the anvil roll 221 is worn out due to a long term operation, the bolt 224 that secures the retention plate 222 to the pressure bearing seat 223 is released to have the bolt 224 set in an un-tightened condition, and the anvil roll 221 is thus allowed to be rotated by an angle within the receptacle channel 225 of the pressure bearing seat 223 to shift away the worn contact edge. The bolt 224 is then tightened again to re-secure the retention plate 222 to the pressure bearing seat 223, whereby a new contact edge is provided between the anvil roll 221 and the opening cutter blade 211 and the new contact edge will take any rolling force applied thereto in the subsequent operation. In this way, the anvil roll 221 can be repeatedly used for several times, whereby the frequency of replacing the anvil roll 221 is reduced and the cost of replacing the anvil roll 221 is saved.

Figure 8:
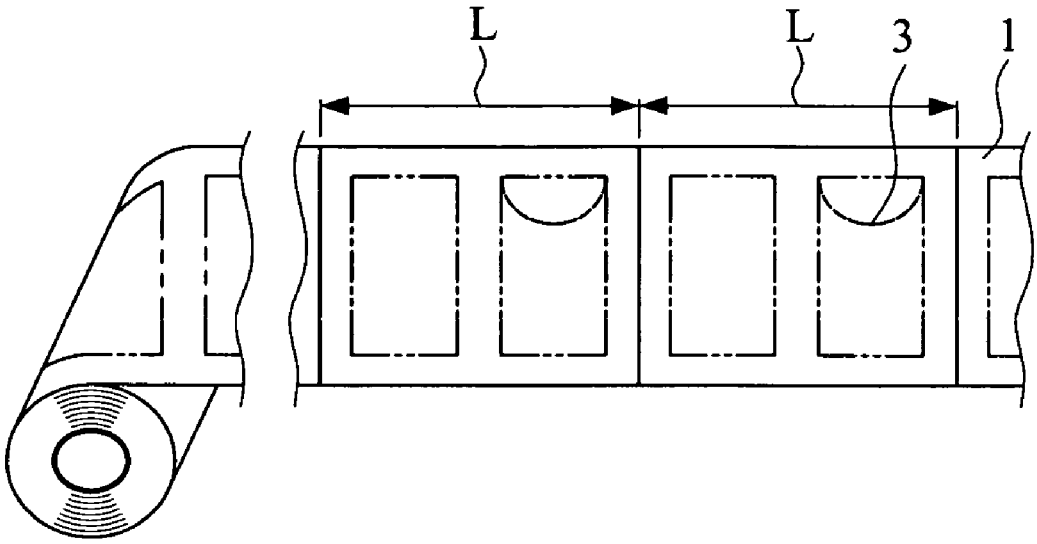
FIG. 8 is a schematic perspective view of a plastic packaging film.
Figure 9:
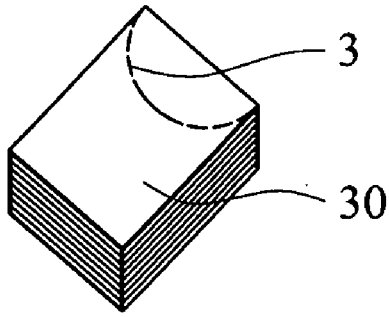
FIG. 9 is a schematic perspective view of a packaged tissue paper pack.

With simultaneous reference to both FIGS. 8 and 9, of which FIG. 8 shows a schematic perspective view of a plastic packaging film and FIG. 9 illustrates a schematic perspective view of a packaged tissue pack. As shown, the plastic packaging film 1, after subjected to rolling operation by the opening cutter blade 211 and the anvil roll 221, forms an opening perforation line 3 at every predetermined interval or distance L. A predetermined number of tissue paper sheets are packaged with the plastic packaging film 1 to form a tissue pack 30. By tearing off the opening perforation line 3 that is formed in the tissue pack 30, the tissue paper sheets can be withdrawn for use.

Figure 10:
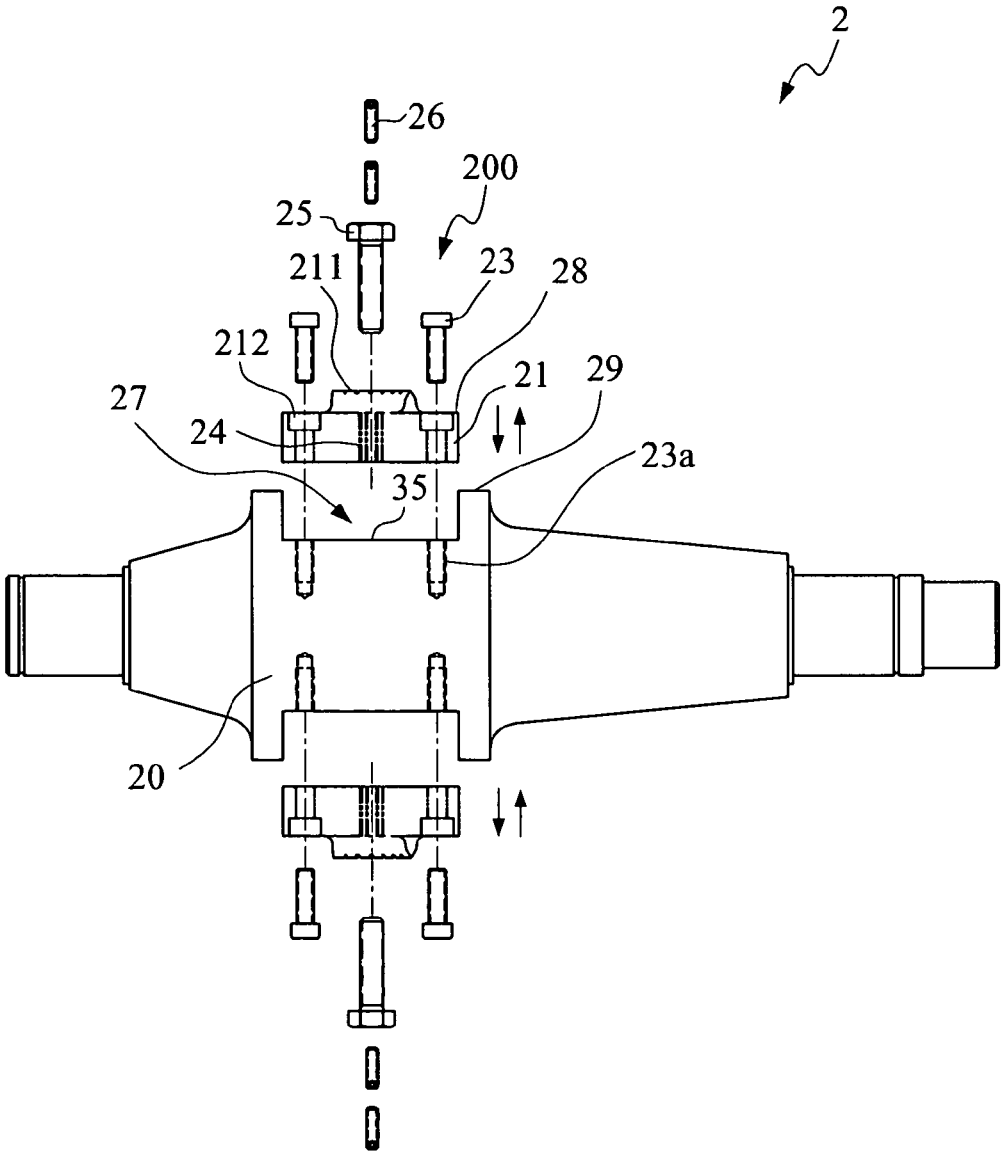
FIG. 10 is a schematic plan view of the present invention.
Figure 11:
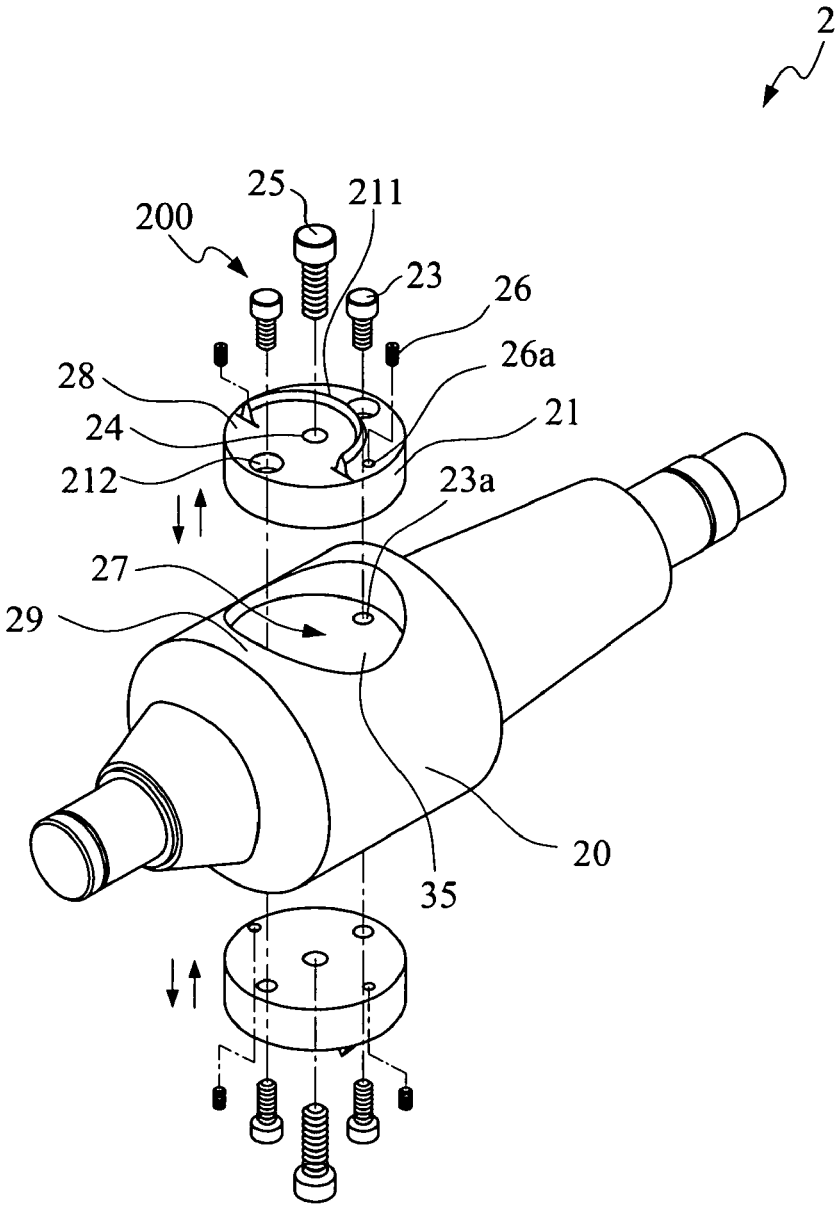
FIG. 11 is a schematic perspective view of the present invention.
Figure 12:
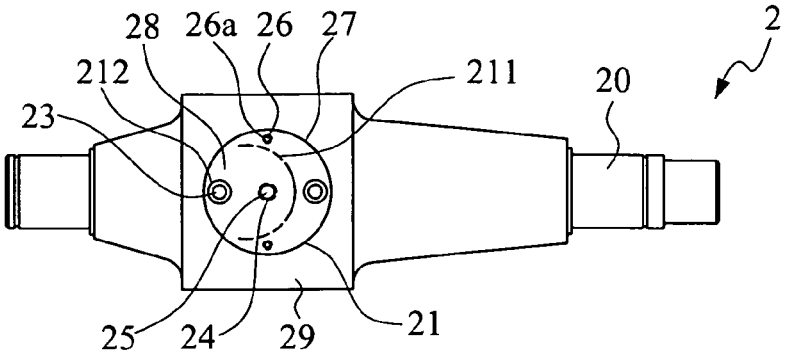
FIGS. 12-15 are top plan views showing, respectively, various configurations of the opening cutter blade provided for the present invention.
Figure 13:
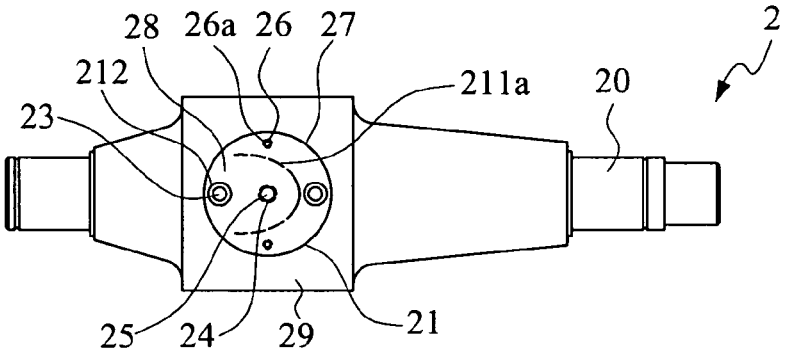
Figure 14:
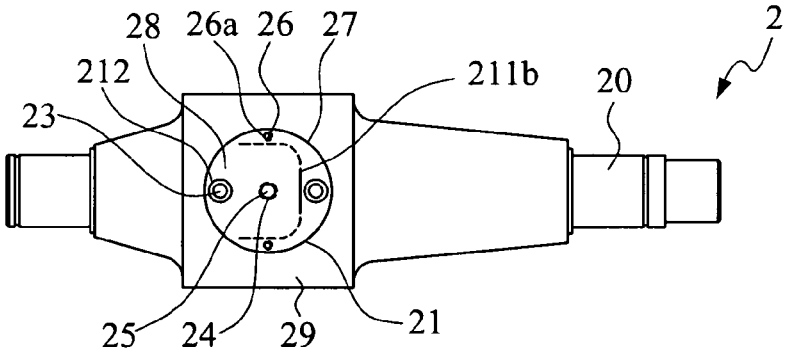
Figure 15:
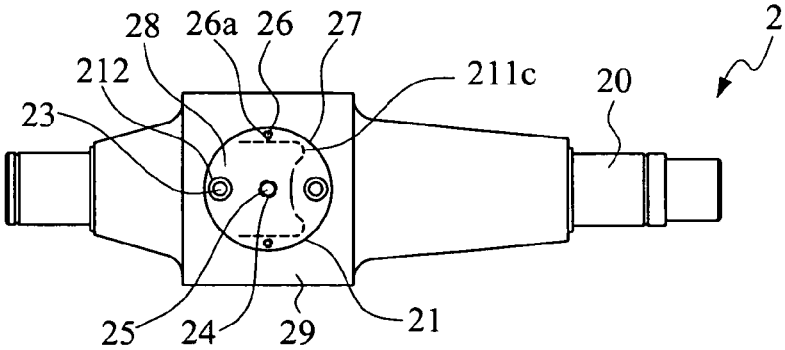
Figure 16:
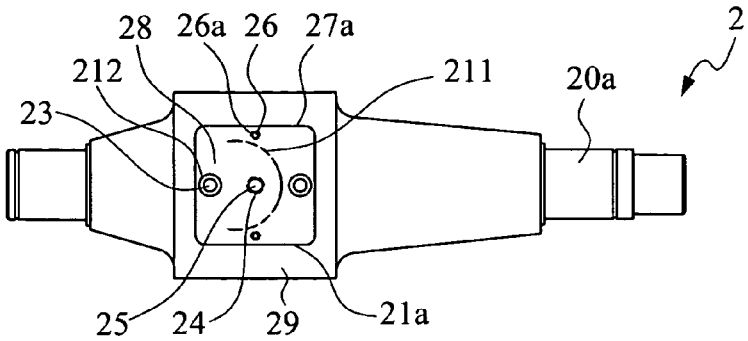
FIGS. 16-19 are top plan views showing, respectively, various configurations of an opening cutter seat provided for the present invention.
Figure 17:
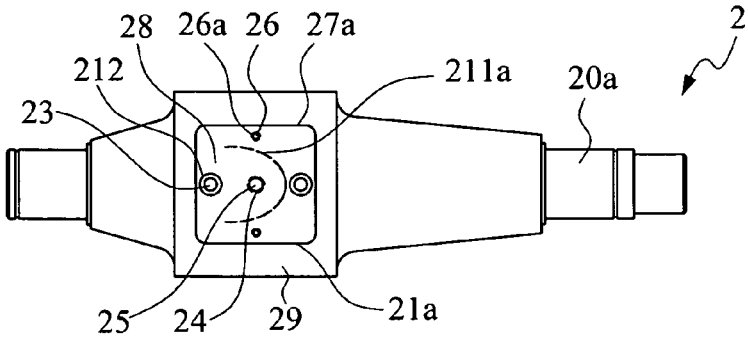
Figure 18:
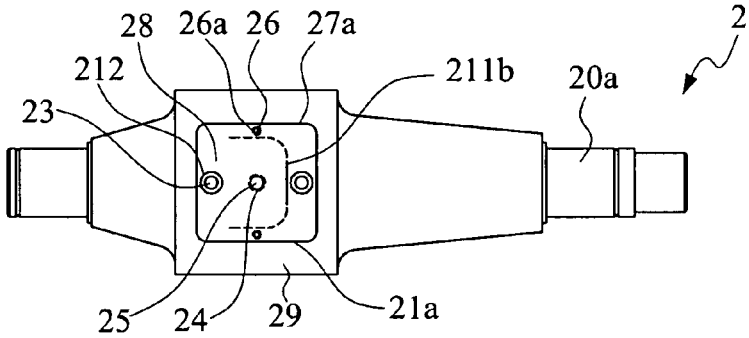
Figure 19:
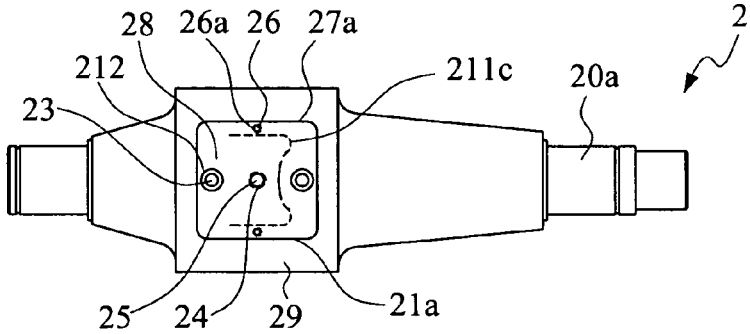

Reference is now made simultaneously to FIGS. 10 and 11, of which FIG. 10 is a schematic plan view of the present invention and FIG. 11 is a schematic perspective view of the present invention. As shown, the opening cutter shaft 20 of the opening cutter assembly 2 has at least one containing compartment 27 formed. The opening cutter seat 21 of the opening cutter assembly 2 is accommodated in and engaged to the corresponding containing compartment 27 of the opening cutter shaft 20 by the cutter seat mounting mechanism 200. The opening cutter blade 211 is mounted to an end surface 28 of the opening cutter seat 21. In the instant embodiment, the cutter seat mounting mechanism 200 comprises at least one cutter bolt 23, at least one threaded cutter hole 23*a* and at least one post hole 212. The cutter hole 23*a* is defined in a bottom 35 of the containing compartment 27 of the opening cutter shaft 20. The post hole 212 is defined in the opening cutter seat 21 and corresponds to the cutter hole 23*a* of the opening cutter shaft 20. The post hole and the cutter bolt 23 are fastened by the cutter bolt 23 to have the opening cutter seat 21 engaging with the opening cutter shaft 20.

The opening cutter seat 21 of the opening cutter assembly 2 is provided with a threaded removal hole 24 and at least one threaded adjustment hole 26*a*. When there is a need to replace a long-term used and thus worn opening cutter blade 211 or to replace one having a different configuration, an operator releases the cutter bolt 23 of the cutter seat mounting mechanism 200 and then screws at least one removal bolt 25 into the removal hole 24 to a predetermined depth, whereby the operator may use his or her hand or a tool to grip a free end of the removal bolt 25 to remove the opening cutter seat 21. Then, a new opening cutter seat 21 can be installed and the cutter bolt 23 is tightened again to complete the replacement operation of the opening cutter seat 21. When the opening cutter assembly 2 of the rolling mechanism 100 for having an opening perforation line on a plastic packaging film is set in operation, the removal bolt 25 must be removed first in order to prevent the anvil roll 221 from being struck by the removal bolt 25 in the rolling operation.

The opening cutter shaft 20 has a cylindrical circumferential surface 29. In case it is found that the end surface 28 of the opening cutter seat 21 and the cylindrical surface 29 of the opening cutter shaft 20 do not match with each other along the outer cylindrical contour, or the anvil roll 221 and the opening cutter blade 211 cannot carry out rolling operation properly, the cutter bolt 23 of the cutter seat mounting mechanism 200 is first released and an adjustment bolt 26 engaging the adjustment hole 26*a* is adjusted in such a way that when the adjustment bolt 26 gets into contact with the bottom 35 of the containing compartment 27 of the opening cutter shaft 20, further rotating the adjustment bolt 26 in either clockwise direction or counterclockwise direction may adjust the assembled height of the opening cutter seat 21 and when a desired height is reached, the cutter bolt 23 is firmly secured. This operation can be carried out repeatedly until the anvil roll 221 and the opening cutter blade 211 can properly carry out rolling operation to have a uniform opening perforation line 3 at a predetermined location in the plastic packaging film 1.

The adjustment hole 26*a* that engages the adjustment bolt 26 can be set at any desired location in the opening cutter seat 21 of the opening cutter assembly 2 according to practical needs. The adjustment bolt 26 can be a bolt having a consistent diameter through the whole bolt body thereof and can be one available from the market. The cutter bolt 23 and the removal bolt 25 can also be bolts that are readily available from the market. The cutter bolt 23 is preferably of the type of countersink bolt.

Referring to FIGS. 12-15, various configurations of the opening cutter blade provided for the present invention are shown. As shown, the opening cutter seat 21 of the opening cutter assembly 2 has a cylindrical body carrying an opening cutter blade 211 that can be a semi-circular blade 211, a curved blade 211*a*, a rectangular blade 211*b*, or an M-shaped blade 211*c*.

Referring to FIGS. 16-19, various configurations of the opening cutter seat provided for the present invention are shown. As shown, the opening cutter seat 21*a* of the opening cutter assembly 2 can be formed as a rectangular body and the opening cutter shaft 20*a* of the opening cutter assembly 2 forms a rectangular containing compartment 27*a* corresponding to the rectangular body of the opening cutter seat 21*a*.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An opening cutter assembly of a rolling mechanism for forming an opening perforation line on a plastic packaging film against an anvil roll as the plastic packaging film is fed through the rolling mechanism, the opening cutter assembly comprising:

an opening cutter shaft having at least one containing compartment recessed into an outer surface thereof, the containing compartment defining a side wall portion peripherally enclosing a floor portion at all sides;

at least one opening cutter seat nested within said containing compartment and disposed in a height adjustable manner on the floor portion within the containing compartment, the opening cutter seat being releasably coupled to the opening cutter shaft by a cutter seat mounting mechanism, wherein the opening cutter seat is set adjacent to the anvil roll;

an adjustment mechanism coupled to said opening cutter seat and bearing against said floor portion for maintaining said opening cutter seat in fixed relation to said floor portion when said height is being adjusted; and at least one opening cutter blade mounted to an upper surface of each opening cutter seat.

2. The opening cutter assembly as claimed in claim 1, wherein the cutter seat mounting mechanism comprises at least one cutter bolt, at least one threaded cutter hole and at least one post hole, the cutter hole being defined in a bottom of the containing compartment of the opening cutter shaft, the post hole being defined in the opening cutter seat and corresponding to the cutter hole of the opening cutter shaft, wherein the post hole and the cutter hole are fastened by the cutter bolt to have the opening cutter seat engaging with the opening cutter shaft.

3. The opening cutter assembly as claimed in claim 1 further comprising at least one removal bolt, wherein the opening cutter seat forms a threaded hole therein for being applied to engage with the removal bolt.

4. The opening cutter assembly as claimed in claim 1 wherein said adjustment mechanism includes an adjustment bolt, wherein the opening cutter seat forms a threaded hole therein for being applied to engage with the adjustment bolt.

5. The opening cutter assembly as claimed in claim 1, wherein the opening cutter seat comprises a cylindrical body.

6. The opening cutter assembly as claimed in claim 1, wherein the opening cutter seat comprises a rectangular body.

7. The opening cutter assembly as claimed in claim 1, wherein the opening cutter blade comprises a semi-circular blade.

8. The opening cutter assembly as claimed in claim 1, wherein the opening cutter blade comprises a curved blade.

9. The opening cutter assembly as claimed in claim 1, wherein the opening cutter blade comprises a rectangular blade.

10. The opening cutter assembly as claimed in claim 1, wherein the opening cutter blade comprises a a blade having straight side portions interconnected by an arcuate top portion.

* * * * *